US005823428A

United States Patent [19]

Humberstone et al.

[11] Patent Number: 5,823,428

[45] Date of Patent: Oct. 20, 1998

[54] LIQUID SPRAY APPARATUS AND METHOD

[75] Inventors: Victor Carey Humberstone; Andrew Jonathan Sant, both of Cambridge, United Kingdom

[73] Assignee: The Technology Partnership PLC, Hertfordshire, United Kingdom

[21] Appl. No.: 646,271

[22] PCT Filed: Dec. 8, 1994

[86] PCT No.: PCT/GB94/02692

§ 371 Date: May 16, 1996

§ 102(e) Date: May 16, 1996

[87] PCT Pub. No.: WO95/15822

PCT Pub. Date: Jun. 15, 1995

[30] Foreign Application Priority Data

Jun. 23, 1994 [GB] United Kingdom ..... 9412669

[51] Int. Cl.[6] ..... B05B 17/06

[52] U.S. Cl. ..... 239/4; 239/102.2; 239/558; 239/601

[58] Field of Search ..... 239/596, 601, 239/4, 102.2, 558; 347/47, 68

[56] References Cited

U.S. PATENT DOCUMENTS

| | | | |
|---|---|---|---|
| 3,683,212 | 8/1972 | Zultan . | |
| 3,738,574 | 6/1973 | Guntersdorfer et al. . | |
| 3,823,408 | 7/1974 | Gordon | 347/47 |
| 3,913,838 | 10/1975 | Richter | 239/601 X |
| 4,243,993 | 1/1981 | Wright et al. | 346/140 R |
| 4,246,076 | 1/1981 | Gardner | 347/47 X |
| 4,496,960 | 1/1985 | Fischbeck | 346/140 R |
| 4,533,082 | 8/1985 | Maehara et al. . | |
| 4,605,167 | 8/1986 | Maehara . | |
| 5,152,456 | 10/1992 | Ross et al. . | |
| 5,153,612 | 10/1992 | Dunn et al. | 346/140 R |
| 5,261,601 | 11/1993 | Ross et al. . | |
| 5,299,739 | 4/1994 | Takahashi et al. . | |

FOREIGN PATENT DOCUMENTS

| | | | |
|---|---|---|---|
| 480615 | 4/1992 | European Pat. Off. . | |
| 57-5595 | 12/1982 | Japan | 239/102.2 |
| 92/2262 | 6/1993 | WIPO | 239/102.2 |

*Primary Examiner*—Kevin Weldon
*Attorney, Agent, or Firm*—Watson Cole Grindle Watson P.L.L.C.

[57] ABSTRACT

A method of and apparatus for atomizing a liquid are disclosed, in which a liquid is caused to pass through tapered perforations (50) in a vibrating membrane (5) in the direction from that side of the membrane (5) at which the perforations (50) have a smaller cross-sectional area to that side of the membrane (5) at which the perforations (50) have a larger cross-sectional area.

27 Claims, 7 Drawing Sheets

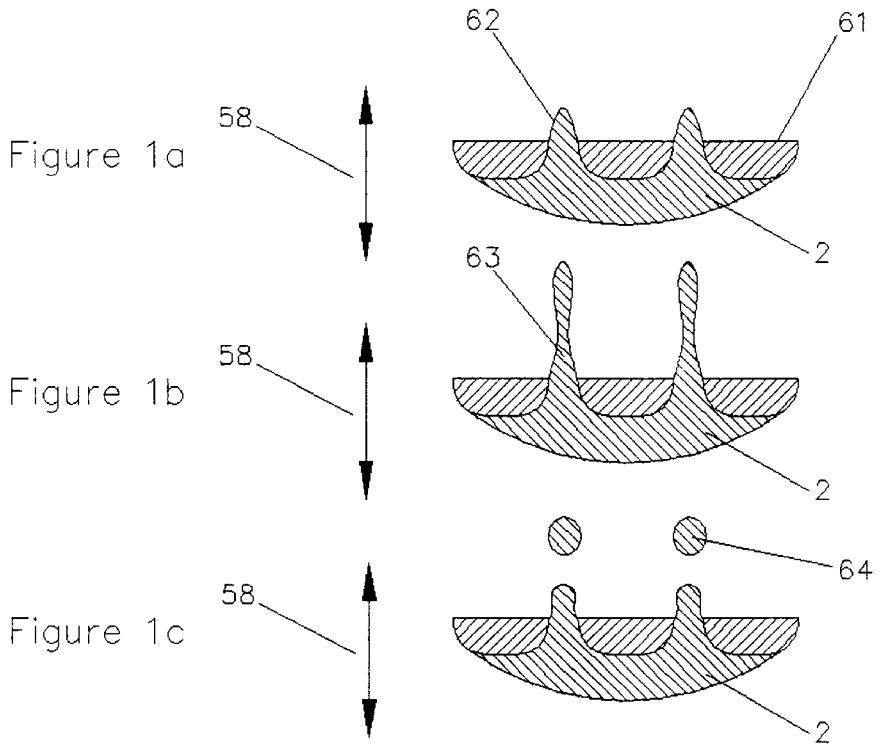
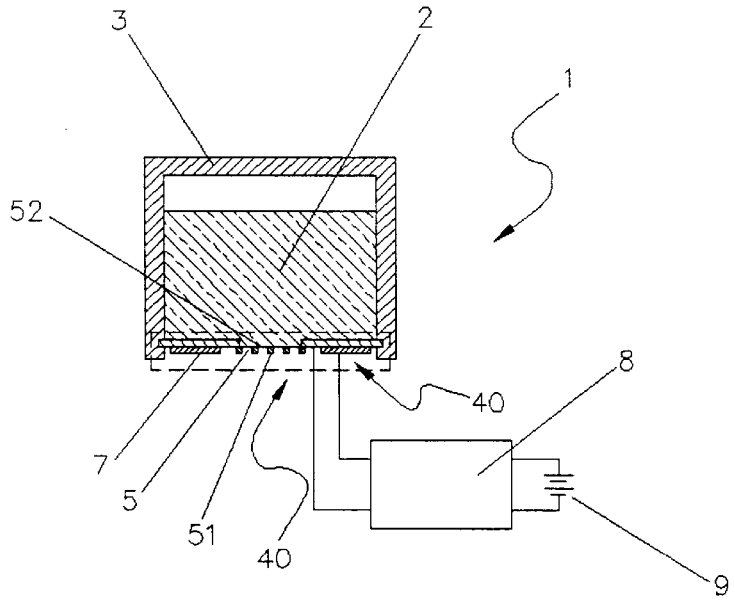
Figure 2

LIQUID SPRAY APPARATUS AND METHOD

BACKGROUND OF THE INVENTION

This invention relates to apparatus and methods for the production of sprays of liquid or of liquid emulsions or suspensions (hereinafter called 'liquids') by means of an actuator.

It is known to produce fine droplet sprays by the action of high frequency mechanical oscillations upon a liquid at its surface with ambient air. Prior art of possible relevance includes: EP-A-0 432 992, GB-A-2 263 076, EP-A-0 516 565, U.S. Pat. No. 3,738,574, EP-A-0 480 615, U.S. Pat. No. 4,533,082 & U.S. Pat. No. 4,605,167.

In some instances (e.g. U.S. Pat. No. 3,738,574) the liquid is introduced as a thin film formed on a plate excited in bending oscillation by the transmission of ultrasonic vibrations from a remote piezoelectric transducer through a solid coupling medium structure.

In some instances (e.g. U.S. Pat. No. 4,533,082) the mechanical oscillations are propagated as sonic or ultrasonic vibrational waves through the liquid towards a perforate membrane or plate (hereinafter referred to as a membrane) that otherwise retains the liquid. The action of the vibrational waves in the liquid causes the liquid to be ejected as droplets through the perforations of the membrane. In these cases, it has been found advantageous to make the pores decrease in size towards the 'front' face (herein defined as that face from which liquid droplets emerge) from the 'rear' face (herein defined as the face opposite the 'front' face).

In other instances (e.g. EP-A-0 516 565) which may be regarded as an amalgamation of the two cases cited above, the mechanical oscillations pass through a thin layer of the liquid towards a perforate membrane that otherwise retains the liquid. In EP-A-0 516 565 there is no teaching of any advantages or disadvantages for particular geometrical forms of perforation.

In yet other instances (e.g. GB-A-2 263 076, U.S. Pat. No. 4,605,167 and EP-A-0 432 992) the source of mechanical oscillations is mechanically coupled to a perforate membrane that otherwise retains the liquid. The action of the oscillations causes the liquid to be ejected as droplets through the perforations of the membrane. In these cases, it again has been found advantageous to make the perforations decrease in size from the 'rear' face towards the 'front', droplet-emitting, face of the membrane.

The devices above can be classified into two types:

Spray devices of the first general type, for example as disclosed in U.S. Pat. No. 3,378,574 and EP-A-0 516 565, transmit the vibration through the liquid to the liquid surface from which the spray is produced, but they describe no geometrical features at that surface which influence droplet size. They either have no perforate membrane to retain the liquid in the absence of oscillation (as in U.S. Pat. No. 3,378,574) or they do possess a perforate membrane, but the perforations do not influence droplet size (as in EP-A-0 516 565, eg column 6, line 21).

Spray devices of the second general type, for example as disclosed in U.S. Pat. No. 4,605,167, U.S. Pat. No. 4,533,082, EP-A-0 432 992 and GB-A-2 263 076, have a perforate membrane bounding or defining the liquid surface at which droplets are produced and the membrane perforations do have an influence upon droplet size. In these cases the present inventors have observed that a substantially cylindrical fluid jet emerges from the 'small-orifice' opening in the front face of the membrane and that this jet oscillates towards and away from the membrane once per cycle of vibration. When the excitation is sufficiently strong the end portion of the jet breaks off to form a free droplet. This behaviour is represented in FIG. 1. In both cases, the droplet diameter typically lies in the range 1.5 to 2 times the diameter of the small-orifice opening in the 'front' face of the membrane. This relationship is also well known in ink jet printing, and has been found in many studies of the instability of liquid jets. The benefit to spray production of having orifices that reduce in size towards the 'front' face is common to all these devices and is also known from ink jet technology. See, for example, U.S. Pat. No. 3,683,212.

The first type of device is relatively inefficient in use of electrical input energy to its (piezoelectric) vibration actuator. For example a practical device of the type described in U.S. Pat. No. 3,378,574 may atomise 2.5 microlitres of water for 1 joule of input energy. The improvement of EP-A-0 516 565 is claimed to allow about 10 microlitres to be so atomised with 1 joule, but limits liquid feed to capillary action requiring a membrane carefully separated from the actuator and a relatively complex construction. Neither provides an apparatus in which the membrane perforations have a substantial influence on droplet size. Further, in delivery of suspension-drugs and in other applications the constraint of EP-A-0 516 565 to capillary feed and the absence of function of the perforations to define or to influence the droplet size can be disadvantageous. It is generally desirable to be free to select from a wide variety of liquid feed methods to achieve the most appropriate method for the application. For example, for sprays of pharmaceuticals it is desirable to provide a metered dose of liquid to the atomiser and to avoid 'hang-up' i.e. residual drug liquid left on the atomiser that could aid contamination of subsequent dose deliveries. For other, larger, suspensates, for example antiperspirant suspensions, the limited range of capillary-gaps could lead to blockage of the capillary feed. It is also helpful for the droplet size to be determined or at least influenced by physical features of the apparatus, so that by maintaining manufacturing quality of the apparatus, repeatability of droplet size can be assisted.

Devices of the second type with perforations narrowing in the direction in which droplets are ejected generally have larger ratio of droplet size larger than orifice exit diameter. This makes it difficult for such devices to atomise suspensions into droplets unless the solids particle size is markedly smaller than the desired droplet diameter.

Secondly, devices of the second type are also poorly adapted to creation of sprays with very small droplet size. For example, it is desirable to create sprays of suspensions or of solutions of pharmaceutical drugs in a form suitable for inhalation by patients. Typically, for pulmonary delivery of asthmatic drugs, sprays with mean droplet size in the region of 6 $\mu$m are desirable to allow 'targeting' of the drug delivery to the optimum region within the pulmonary tract. With devices of the second type this may require perforations with exit diameter in the region of 3 $\mu$m to 4 $\mu$m. Membranes of such small perforation size are difficult and expensive to manufacture and may not have good repeatability of perforation size, droplet diameter and therefore of such 'targeting'. In addition, such suspension drug formulations are often most readily produced with mean solids size around 2 $\mu$m. With such small orifices and with such solids particle sizes, blockage or poor delivery can occur.

Thirdly, even for large droplet sizes, the flow of solids carried in liquid suspension into a narrowing perforation can induce blocking, particularly when the solids size is comparable with the size of the channel. As one example the relatively large diameter of the perforation at the rear face of the membrane admits particles too large to be able to pass through the relatively small perforation diameter at the front face. As a second example, the narrowing of the perforation may and in general will bring two or more solid particles into contact both with each other and with the sidewalls of the perforation. These may then be unable to continue forward motion and so induce blocking.

SUMMARY OF THE INVENTION

Objects of the present invention include the provision of a form of spray device that is of low cost, of simple construction or which is capable of operation with a wide range of liquids, liquid suspensions and liquid feed means.

According to a first aspect of the present invention there is provided a liquid droplet spray device comprising:

a perforate membrane;

an actuator, for vibrating the membrane; and means for supplying liquid to a surface of the membrane, characterised in that perforations in the membrane have a larger cross-sectional area at that face of the membrane away from which liquid droplets emerge than at the opposite face of the membrane. Throughout this specification, the term 'membrane' includes the term 'plate'.

The actuator may be a piezoelectric actuator adapted to operate in the bending mode. Preferably the thickness of that actuator is substantially smaller than at least one other dimension.

Preferably, means are provided to create a pressure difference such that the pressure exerted by the ambient gas either directly or indirectly on the droplet-emergent surface of the membrane equals or exceeds the pressure of liquid contacting the opposite membrane surface, but which pressure difference is not substantially greater than that pressure at which gas passes through the perforations of the membrane into said liquid. The pressure exerted by said ambient gas may be indirectly exerted, for example, when it acts on a liquid film that itself is formed upon that face of the membrane. The liquid supply means or the effect of operation of the device itself to expel droplets of liquid from a closed reservoir or some other means may be used to create this pressure difference.

Preferably, the device includes a pressure bias means providing a lower pressure in the liquid opposing the passage of the liquid through the perforations.

Advantageously, the perforations, on that face of the membrane away from which liquid droplets emerge, are not touching.

The means for supplying liquid to a surface of the membrane preferably comprises a capillary feed mechanism or a bubble-generator feed mechanism.

The device may include both normally tapered and reverse tapered perforations. The normally tapered perforations are the preferably disposed around the outside of the reverse tapered perforations. The means for supplying liquid to a surface of the membrane may be adapted to supply said liquid to the face of said membrane away from which liquid droplets emerge.

According to a further aspect of the invention, there is provided a method of atomising a liquid in which a liquid is caused to pass through tapered perforations in a vibrating membrane in the direction from that side of the membrane at which the perforations have a smaller cross-sectional area to that side of the membrane at which the perforations have a larger cross-sectional area.

It is believed by the inventors that apparatus according to the present invention operates by means of exciting capillary waves in the liquid to be atomised. Their understanding of such capillary-wave atomisation is given below.

Hereinafter, in the text and claims, perforations which have larger area at the rear face than at the front, droplet-emergent, face will be referred to as 'normally tapered' and perforations which have smaller area at the rear face than at the front face will be referred to as 'reverse tapered'. We correspondingly define 'reverse-tapered' and 'normally-tapered' membranes.

The actuator, its mounting and the electronic drive circuit for operating the actuator may, for example, take any of the prior art forms disclosed in WO-A-93 10910, EP-A-0 432 992, U.S. Pat. No. 4,533,082, U.S. Pat. No. 4,605,167 or other suitable forms that may be convenient. It is found generally desirable for the actuator and drive electronics to act cooperatively to produce such resonant vibrational excitation.

One advantage of this arrangement is that simple and low cost apparatus may be used for production of a droplet spray of liquid suspensions wherein the ratio of mean droplet size to mean suspensate particle size can be reduced over prior art apparatus.

A second advantage of this arrangement is that liquid and liquid suspension sprays of small droplet diameter suitable for pulmonary inhalation can be produced, using membranes that are easier to manufacture and which have reduced likelihood in use of blockage of the perforations.

A third advantage of this arrangement is that relatively low-velocity liquid sprays suitable for uniform coating of surfaces can be produced.

BRIEF DESCRIPTION OF THE DRAWINGS

Preferred embodiments of the invention will now be described by way of example only and with reference to the accompanying drawings, in which:

FIG. 1 is a schematic section of prior art apparatus showing, in sequence, successive stages of the ejection of a liquid droplet from perforations which are smaller in area at the front of the membrane (from which droplets emerge) than at the rear of the membrane;

FIG. 2 shows, in section, a preferred droplet dispensation apparatus;

DESCRIPTION OF THE INVENTION

Figure 3A:
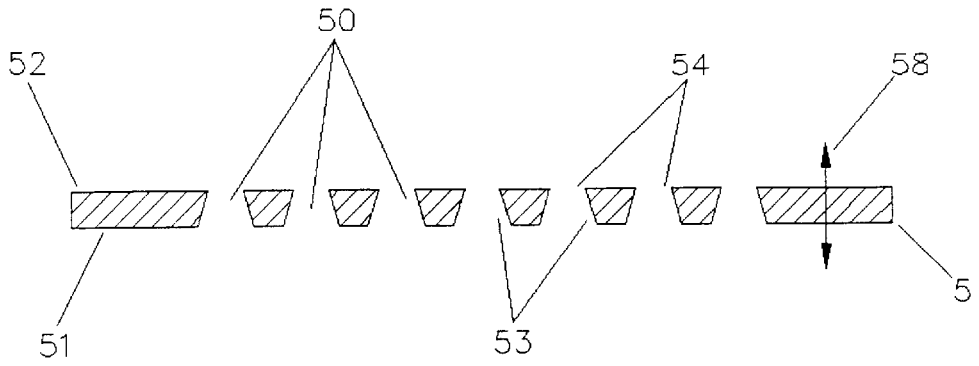
FIG. 3 illustrates, in section, preferred forms of perforate membrane for the apparatus of FIG. 2.

FIG. 1 shows a membrane 61 having 'normally' tapered perforations and in vibratory motion shown by arrow 58 (in a direction substantially perpendicular to the plane of the membrane) against a liquid body 2 contacting its rear face. FIGS. 1*a* to 1*c* show, in sequence during one cycle of vibratory motion, the understood evolution of the liquid meniscus 62 to create a substantially cylindrical jet of fluid 63 from the tapered perforations and the subsequent formation of a free droplet 64.

FIG. 2 shows a droplet dispensing apparatus 1 comprising an enclosure 3 directly feeding liquid 2 to the rear face 52 of a perforate membrane 5 and a vibration means or actuator 7, shown by way of example as an annular electroacoustic disc and substrate and operable by an electronic circuit 8. The circuit 8 derives electrical power from a power supply 9 to vibrate the perforate membrane 5 substantially perpendicular to the plane of the membrane, so producing droplets of liquid emerging away from the front face 51 of the perforate membrane. Perforate membrane 5 and actuator 7 in combination are hereinafter referred to as aerosol head 40.

The aerosol head 40 is held captured in a manner that does not unduly restrict its vibratory motion, for example by a grooved annular mounting formed of a soft silicone rubber (not shown). Liquid storage and delivery to rear face 52 are effected, for example, by an enclosure 3 as shown in FIG. 2.

FIG. 3*a* shows cross-sectional detail of a first example perforate membrane 5, which is operable to vibrate substantially in the direction of arrow 58 and which is suitable for use with droplet dispensing apparatus 1 to produce fine aerosol sprays. In one embodiment the membrane 5 comprises a circular layer of polymer which contains a plurality of tapered conical perforations 50. Each perforation 50 has openings 53 in the front exit face and openings 54 in the rear entry face, which perforations are laid out in a square lattice. Such perforations may be introduced into polymer membranes by, for example, laser-drilling with an excimer laser.

Figure 3B:
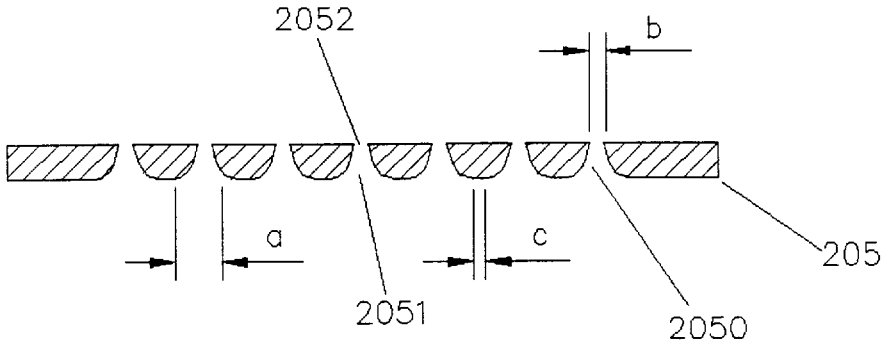

FIG. 3*b* shows cross-sectional detail of a second example perforate membrane 205 according to the invention, which membrane is operable to vibrate substantially and suitable for use with droplet dispensing apparatus 1 in the direction of arrow 58. The membrane is formed as a circular disc of diameter 8 mm from electroformed nickel, and is manufactured, for example, by Stork Veco of Eerbeek, The Netherlands. Its thickness is 70 microns and is formed with a plurality of perforations shown at 2050 which, at 'front' face 2051, are of diameter shown at "a" of 120 microns and at 'rear' face 2052 are of diameter shown at "b" of 30 microns. The perforations are laid out in an equilateral triangular lattice of pitch 170 $\mu$m. The profile of the perforations varies smoothly between the front and rear face diameters through the membrane thickness with substantially flat 'land' regions (shown at "c") of smallest dimension 50 $\mu$m in front face 2051.

Membranes with similar geometrical forms to those described with reference to FIGS. 3*a*,3*b*, fabricated in alternative materials such as glass or silicon, may also be used.

Figure 4A:
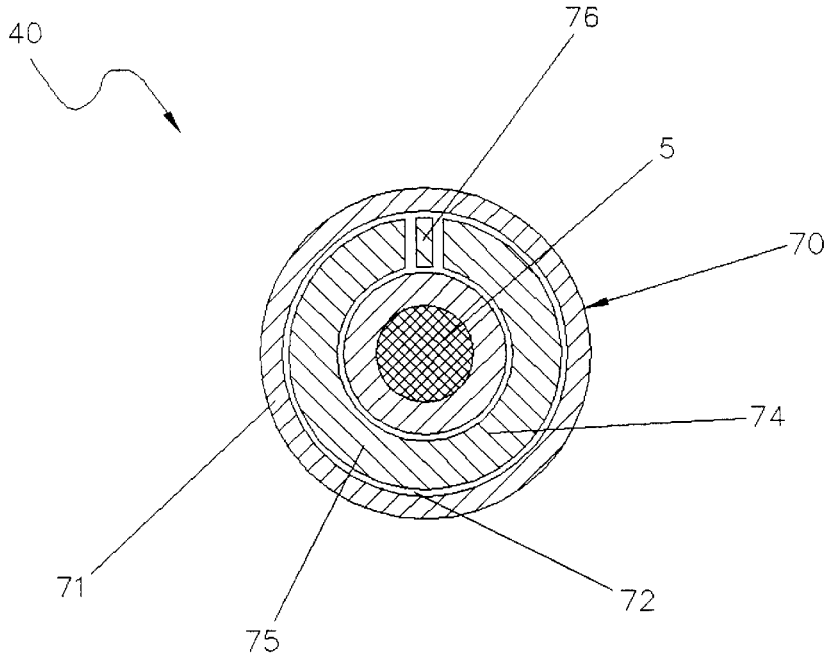
FIG. 4 is a plan and sectional view of a preferred embodiment of an atomising head.
Figure 4B:
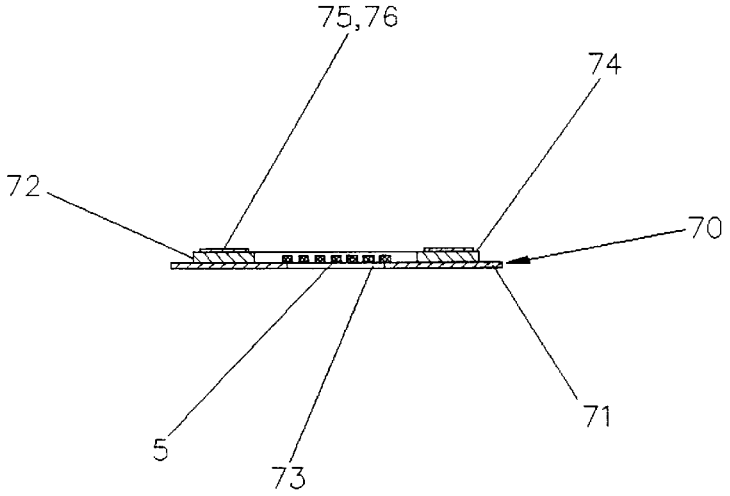

FIG. 4 shows a plan and a sectional view through one appropriate form of the aerosol head 40. This aerosol head consists of an electroacoustical disc 70 comprising an annulus 71 of nickel-iron alloy known as 'Invar' to which a piezoelectric ceramic annulus 72 and the circular perforate membrane 5 are bonded. The perforate membrane is as described with reference to FIG. 3*b*. The nickel-iron annulus has outside diameter 20 mm, thickness 0.2 mm and contains a central concentric hole 73 of diameter 4.5 mm. The piezoelectric ceramic is of type P51 from Hoechst CeramTec of Lauf, Germany and has outside diameter 16 mm, internal diameter 10 mm and thickness 0.25 mm. The upper surface 74 of the ceramic has two electrodes: a drive electrode 75 and an optional sense electrode 76. The sense electrode 76 consists of a 1.5 mm wide metallisation that, in this example, extends radially substantially from the inner to the outer diameter. The drive electrode 75 extends over the rest of the surface and is electrically insulated from the sense electrode by a 0.5 mm air gap. Electrical contacts are made by soldered connections to fine wires not shown.

In operation, the drive electrode 75 is driven using the electronic circuit 8 by a sinusoidal or square-wave signal at a frequency typically in the range 100 to 300 kHz with an amplitude of approximately 30 V to produce a droplet spray emerging away from the front face 51 of the perforate membrane wherein the mean droplet size is typically in the region of 10 microns. The actuator head will in general have vibrational resonances at whose frequencies droplets are produced effectively. At such resonances the signal from the sense electrode 76 has a local maximum at that frequency. The drive circuit may be open-loop, not using the feedback signal from electrode 76, or may be closed-loop using that feedback. In each case the electronic drive circuit can be responsive to the changing electrical behaviour of the actuator head at resonance so that actuator head and drive circuit cooperate to maintain resonant vibration of the actuator head. Closed-loop forms, for example, can ensure that the piezo actuator maintains resonant vibration by maintaining a phase angle between the drive and feedback or sense electrodes that is predetermined to give maximal delivery.

Figure 5A:
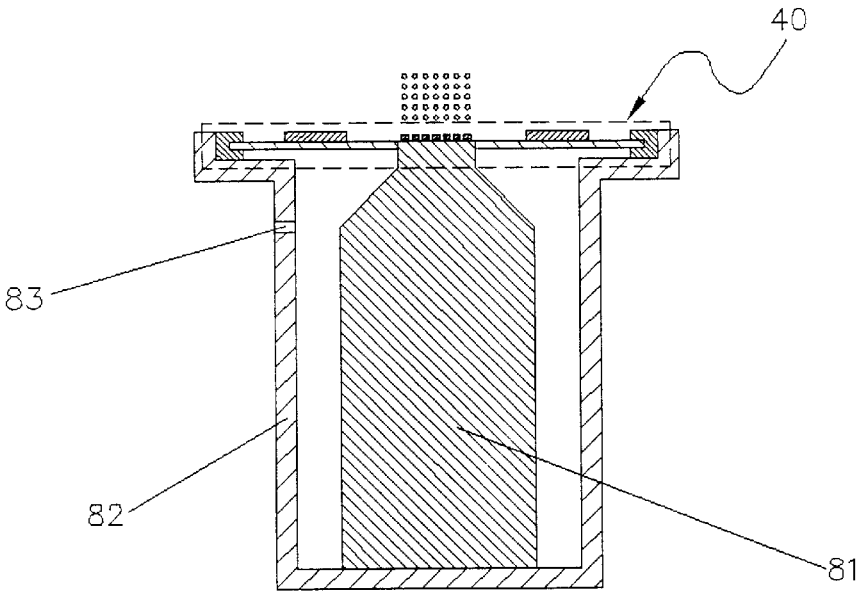
FIG. 5 shows schematic sections of alternative fluid pressure control devices that can be used with an atomising head to form droplet dispensation devices according to the invention.

FIG. 5*a* shows in sectional view, a fluid feed comprising a conduit formed of an open-celled capillary foam. Such a capillary feed may be used to provide liquid pressure control. (The advantage of pressure control is described below.) By the action of vent 83 and capillary 81 liquid is contained within capillary 81 at a pressure below that of the surrounding atmosphere. The pore size in the capillary foam can be used to control the value of this pressure. Surrounding capillary 81 is a robust external housing 82. This arrangement is particularly useful for spray delivery of dangerous, eg toxic, liquids whilst reducing the danger of other means of liquid loss. The capillary action of material 81 has an action to contain the liquid so that liquid escape is reduced or minimised even if damage to the external housing 82 occurs. Applications of this benefit are to retain pharmaceutical or medicinal liquids or flammable liquids.

Figure 5B:
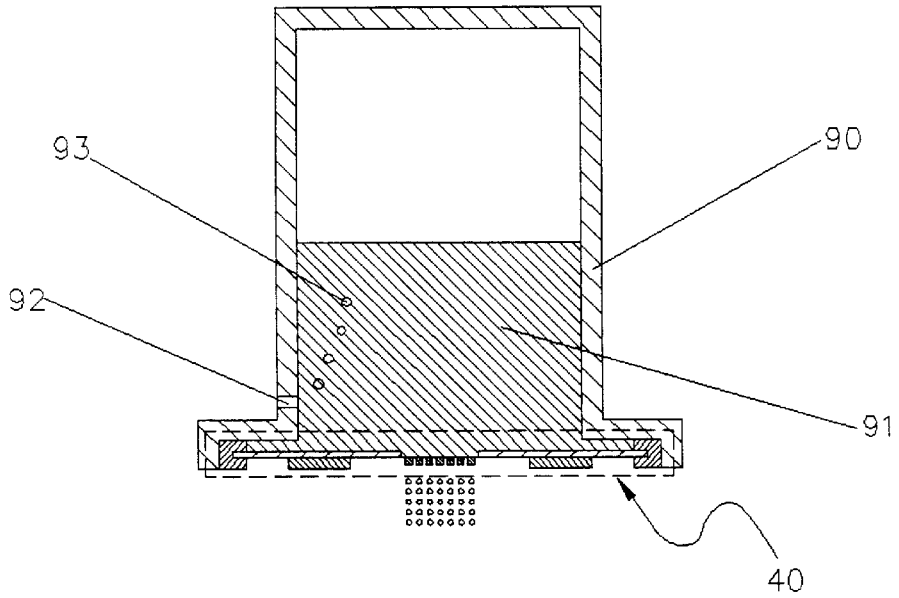

FIG. 5*b* shows in sectional view, a so-called 'bubble generator' device known from the writing instrument art that may also be used to provide liquid pressure control. The action of dispensing liquid from the perforations in the membrane causes the pressure in the reservoir 90 and therefore of the liquid 91 contacting the membrane to decrease below atmospheric pressure. When the pressure is low enough for air to be sucked in against the liquid meniscus pressure through either the membrane perforations or, alternatively through an auxiliary opening (or openings) 92, air is ingested as bubbles until the reservoir pressure rises sufficiently for the liquid meniscus to withstand the pressure differential. In this way the liquid pressure is regulated at a value below the ambient pressure. (Opening 92 is generally selected to be small enough that liquid does not easily leak out of the enclosure.) Both these methods of pressure control, within the pressure range cited above, have been found capable to enhance spray delivery from the atomising head 40 and it is to be understood that other methods may also be suitable within this invention.

Figure 6A:
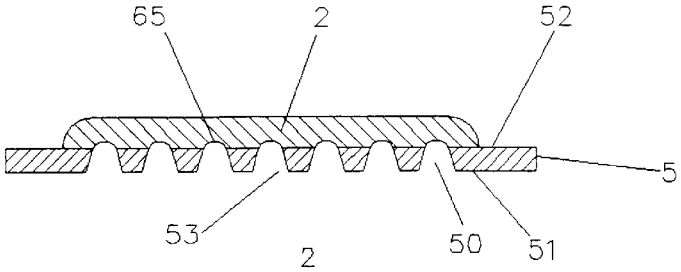
FIG. 6 show methods of droplet generation as understood by the inventors.
Figure 6B:
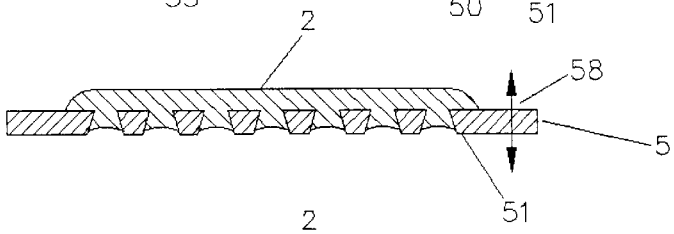

Below follows a description (in relation to FIGS. 6*a* to 6*g*) of methods of operation of the invention. Also described are the droplet generation mechanisms provided by the invention as they are presently perceived by the inventors. These mechanisms are not fully proven nor are they to be understood to be limiting of this invention:

When the pressure difference applied to the liquid is closely zero (ie the pressure of the liquid at the atomising head is closely equal to the pressure on the front face of the perforate membrane) then liquid 2 contacts the membrane with menisci 65 attached at rear face 52 of membrane 5 as shown in FIG. 6*a*. It is observed that, responsively to vibrational excitation 58 of that membrane liquid flows towards the front face 51 of membrane 5, as shown in an intermediate position in FIG. 6*b*.

Figure 6C:
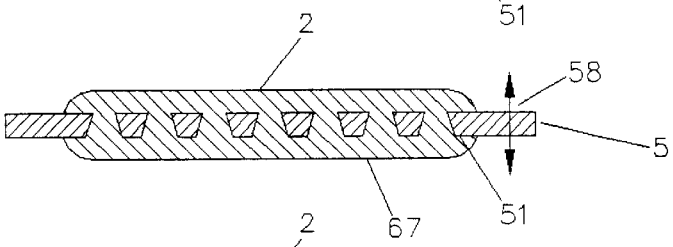
Figure 6D:
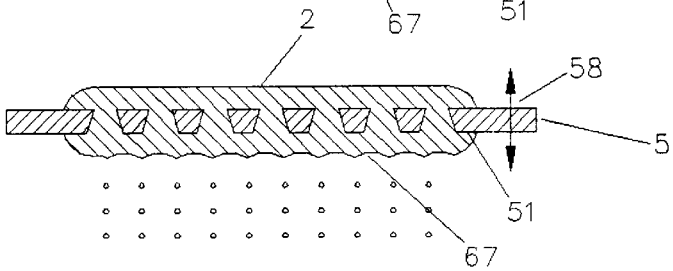

Most commonly, with a pressure difference small compared to that needed for air to be drawn in against the liquid meniscus pressure through the membrane perforations when the membrane is not vibrated, the materials of the membrane and the cross-sectional profile of the perforations allow liquid 2 to flow out on to front face 51 of the membrane as a thin film as shown in FIG. 6*c*. On that face the vibration of membrane 5 can excite capillary waves in the surface of the liquid meniscus 67, as shown in FIG. 6*d*. This has been found to occur, for example when using polymer material for the membrane 5 in the aerosol head described according to FIG. 3*a*. The location of these waves is not constrained by the sidewalls of the perforations 50 or their intersection with the front face 51 that bound the openings 53. If the vibrational amplitude of the liquid meniscus 67 is large enough, droplets will be emitted, typically with a droplet diameter approximately one third of the capillary wavelength (see for example Rozenberg—Principles of Ultrasonic Technology). The perforate form enables effective replenishment of liquid lost as droplets from meniscus 67. The membrane form enables efficient vibrational excitation.

Preferably face 51 is not completely filled with perforations, but the liquid is free to spread out over an area of face 51 larger than the perforation area. This feature allows a balance to be achieved between the rate of flow responsive to vibration 58 (through perforations 50) and the rate at which liquid is sprayed as droplets from capillary waves in meniscus 67. This balance may, alternatively or in combination with the above method, be achieved by use of a pressure differential (opposing the flow through perforations responsively to vibration) small enough that a thin film still forms on face 51. By means of this balance, the flow of excessive liquid onto front face 51, which can inhibit the formation of a droplet spray, is prevented.

Figure 6E:
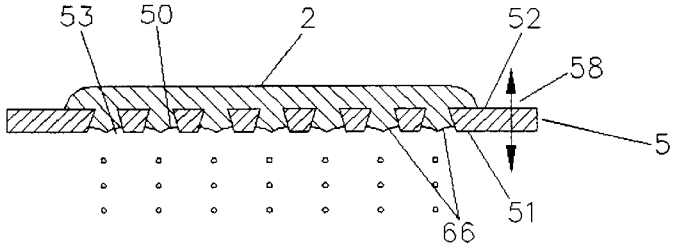

The pressure differential opposing flow through perforations 50 may alternatively be selected so that bulk liquid does not flow onto front face 51 of the membrane 5 but has menisci 66 that contact the membrane 5 at or between the front 51 and rear 52 faces of the membrane, as shown in FIG. 6*e*. In this event the vibration of the membrane can excite vibration in each of the liquid menisci 66 as shown in FIG. 6*e*. (Typically this requires a pressure differential comparable to, but not larger than that needed for air to be drawn in through the perforations against the maximum liquid meniscus pressure in the perforations when the membrane is not vibrated.) The coupling of the vibration of the membrane into the liquid is particularly efficient in this case since the geometry of the perforations complements the geometry of the fluid menisci. The induced excitation of the liquid menisci takes the form of capillary waves. Preferably an integer number of such capillary waves 'fit' within the perforations. In this way the geometry of the perforations is a good match to that of the menisci when excited with capillary waves and those waves are created efficiently. Again droplet ejection is observed with appropriate frequency and amplitude of vibration.

Figure 6F:
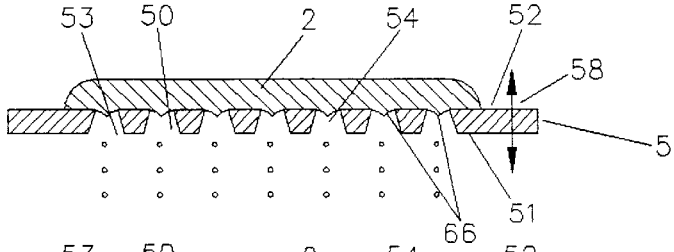
Figure 6G:
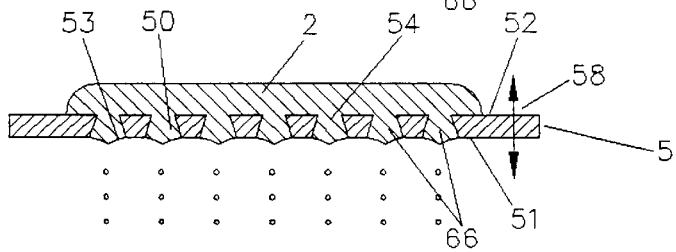

In FIGS. 6*f* and 6*g* are shown special cases according to FIG. 6*e* in which the pressure differential is selected so that the meniscus of liquid is retained either at or in the vicinity of the intersection of the perforations 50 with the rear face 52 (FIG. 6*f*) or with the front face 51 (FIG. 6*g*) of the perforate membrane; whilst capillary waves are formed in that meniscus through the action of vibration 58. Again, this enables efficient vibrational excitation of the meniscus and if the amplitude and frequency of vibration 58 are appropriate, the droplets of liquid are ejected. It is found that a value of pressure differential between zero and that pressure necessary to draw air (or other ambient gas) in through the membrane perforations against the action of the surface tension of the liquid contacting those perforations acts to improve the effectiveness of droplet generation.

In the cases shown in FIGS. 6*e*, 6*f* and 6*g*, conveniently, only a single capillary-wave (i.e. one capillary wavelength) fits within the diameter of the perforation between openings 53 and 54 although, if desired, higher-frequency excitation may be employed so that more than one such capillary-wave so fits. This can be expressed by requiring the following relation approximately to hold at the frequency of vibrational excitation:

$$\Phi \cong n\lambda_c$$

where:

$\Phi$=the diameter of the tapered perforation at some point between the front and the rear face of the membrane n=an integer $\lambda_c$=the wavelength of capillary waves in the liquid The relationship between the wavelength $\lambda_c$ of capillary waves and the excitation frequency, f, is given by:

$$\lambda_c^3 f^2 = 8\pi\sigma/\rho$$

where:

$\sigma$=fluid surface tension (at frequency f)

$\rho$=fluid density.

We find that this relation also holds approximately in the case of capillary waves bounded by the perforations as described above. Therefore, for tapered perforation of diameter $\Phi$ as defined above, it is desirable that the apparatus is designed and operated such that:

$$f^2\Phi^2 = \frac{8\pi\sigma n^3}{\rho}$$

Corresponding to the approximate nature of the relation $\Phi \cong n\lambda_c$ noted above, operation is found to be satisfactory when this relation holds in this range $$\frac{5\pi\sigma n^3}{\rho} < f^2\Phi^3 < \frac{12\pi\sigma n^3}{\rho}$$

In devices where it is advantageous to ensure that only a particular number p, of capillary waves can form within a tapered perforation, the ratio of the large diameter of the perforation (shown at 53) to the small diameter of the perforation should lie in the range 1 to (p+1)/p. This is most effective for small integer values of p.

Since capillary-wave droplets have diameter approximately one-third of the capillary wavelength, $\lambda_c$, apparatus according to the present invention allows droplets to be produced whose diameter is approximately one-third or less of diameter of the exit openings 53. (When the liquid meniscus is maintained at or close to openings 54 in rear face 52 of the membrane, apparatus according to the present invention allows droplets to be produced whose diameter is approximately one-third or less of the diameter of the smaller openings 54. Unlike prior art devices, the dimensions of the perforations then have an influence upon the droplet size and can therefore advantageously be selected to assist in the creation of droplets of the desired diameter.) The apparatus is especially useful for producing small droplets, as required for example in pulmonary drug delivery applications.

Droplet generation occurs according to the apparatus and methods described with regard to FIGS. 6*e,* 6*f* and 6*g* when using a perforate membrane described with reference to FIG. 3*b,* an atomising head described with reference to FIG. 4 and a bubble generator described with reference to FIG. 5*b*. When spraying water from such a device optimum spraying commenced at a pressure differential (opposing fluid flow out onto the front face of the membrane) of −30 mbar. As the pressure differential increased, spray flow rate and efficiency improved up to a pressure differential of −76 mbar. At that pressure the perforate membrane acted as bubble generator and optimum spraying was achieved. This behaviour is typical. Bubble generator, capillary feeds and other means for providing a pressure differential opposing flow therefore give particular advantage for the present invention. Spray operation for this device was achieved with sinusoidal excitation of 30 V amplitude at frequencies of 115, 137, 204 and 262 kHz with corresponding calculated capillary wavelengths in the range 51 $\mu$m to 30 $\mu$m. The latter wavelength corresponds to the minimum opening dimension of the perforations and produces droplets of approximate size 10$\mu$ microns. This device is the best embodiment of the invention known to the inventors for producing droplets in the region of 10 microns.

In these various embodiments, the use of 'reverse-tapered' perforations in the present invention helps to prevent blockage when atomising liquid suspensions: firstly, unlike prior art devices, the perforations do not admit solids particles that cannot pass completely through the membrane (but are agitated by the membrane vibration so not to permanently obscure the perforation); secondly two or more solids particles are not induced to come into contact both with each other and with the sidewalls of the perforations and so block the perforation; thirdly to produce a given droplet size relatively large perforations can be used and so pass relatively large solids particles in liquid suspension without blockage. Apparatus according to this invention further enables relative ease of membrane manufacturing when small droplets, such as those desired for pulmonary drug delivery, as required.

There is also distinction between the relative droplet emission frequencies of the present apparatus and prior art apparatus of similar perforation size. For example, with minimum perforation diameters of 15 $\mu$m, prior art apparatus generally is found to operate to eject droplets at frequencies in the region of 40 kHz. With the present apparatus, droplet ejection typically occurs in the region 400–700 kHz.

Further distinction from prior art apparatus is seen from the actions of the negative liquid bias pressure referred to above. With the prior art devices, eg as shown in FIG. 1, it is known to use negative bias pressures, especially to prevent wetting of the front face of the membrane. However, such bias does not provide for the meniscus to be withdrawn to a new equilibrium position within the perforation—with prior art devices as soon as the bias pressure is sufficient to detach the edge of the meniscus from the intersection of the perforations with the front face of the membrane, the meniscus pulls completely away from the perforation and spray operation is prevented. With the present invention, the pressure difference either is selected still to allow a wetted front face of the membrane or, (in the case where that pressure difference is sufficient to pull the fluid meniscus back within the tapered perforations) enables the fluid meniscus to reach a new equilibrium position within the tapered perforation and thereby maintain stable droplet emission. The latter is believed also enables combinations of bias pressure and frequency to be established at which an integer number of capillary wavelengths 'fit' within the perforation and efficiently eject droplets.

Figure 7:
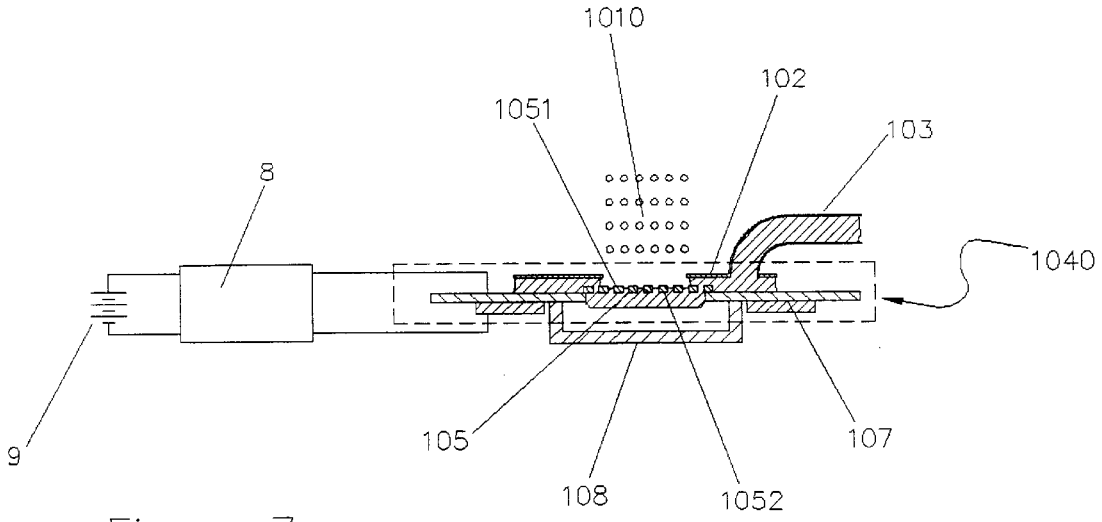
FIG. 7 is a schematic section of a second droplet dispensation apparatus.

FIG. 7 shows a second droplet dispensing apparatus 101 with an alternative liquid feed. The liquid feed includes feed pipe 103, and annular plate 102 acting together with face 1051 of membrane 105 to provide a capillary liquid channel to holes 1060 in membrane 105. Membrane 105 is coupled to a vibration means or actuator 7. Actuator 7 is coupled to sealing support and mount 108, electronic circuit 8 and thence to power supply 9. Feed pipe 103 may be mounted relative to sealing support 108; this is not shown. Circuit 8 and power supply 9 may for example be similar to that shown in the first example apparatus. Vibration of the perforate membrane 105 substantially perpendicular to the plane of the membrane in the direction of arrow 58 produces droplets of liquid 1010 from the front face 1051 of the membrane. Perforate membrane 105 and actuator 107 in combination are hereinafter referred to as aerosol head 1040.

Figure 8:
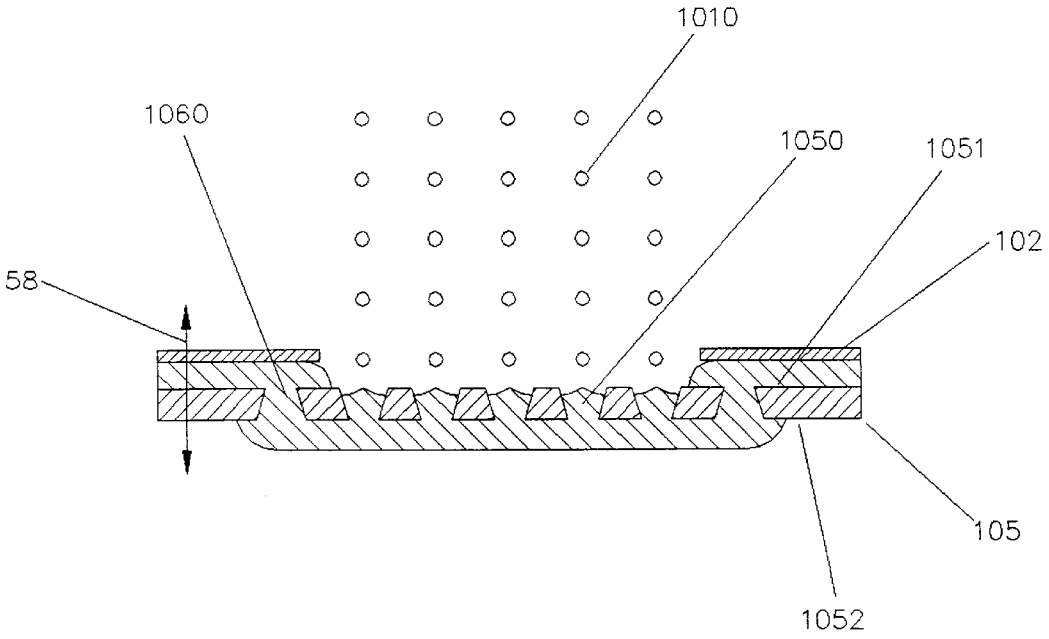
FIG. 8 illustrates, in section, an alternative membrane structure (for the apparatus of FIG. 7)

FIG. 8 shows cross-sectional detail of liquid in contact with the perforate membrane 105. The membrane 105 comprises a layer of polymer which contains a plurality each of normally-tapered and reverse-tapered conical perforations shown at 1060 and 1050. The reverse-tapered perforations 1050 are positioned to be free of liquid on the front face of the membrane. The normally-tapered perforations 1060 are positioned to receive liquid from the front face of the membrane and may, for example, conveniently be laid out peripherally around the reverse-tapered perforations 1050.

In this second droplet dispensation apparatus the droplet generation mechanisms described above for the first example apparatus may be employed. The presence of holes of type 1060 however enables a variety of liquid feeds to the front of the membrane 5 to be employed. Liquid feed is to holes of type 1060 in the front face of the membrane. Conveniently one liquid delivery means may be capillary feed means comprising annular plate 102 acting together with face 1051 of membrane 105. In use, this second example droplet dispensation apparatus acts to transmit liquid through holes type 1060 to the rear face 1052 of membrane 105 and so by liquid wetting action maintains holes type 1050 in the rear face 1052 of said membrane in contact with the liquid, enabling droplet dispensation from the front face of holes 1050 in a manner similar to that of the first example droplet dispensation apparatus. Other details follow those for the first droplet dispensation apparatus described above.

Figure 9:
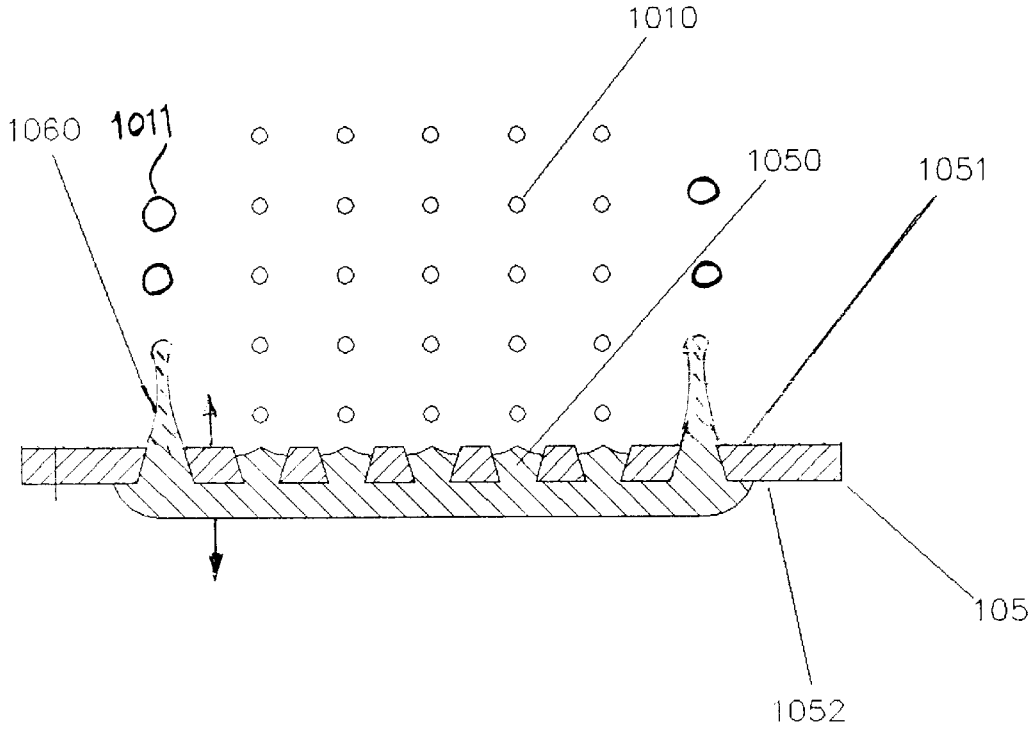
FIG. 9 schematically illustrates in section, droplet ejection from both 'normally' tapered and 'reverse' tapered perforations.

FIG. 9 illustrates a second use of membranes in which the perforations are both 'normally' and 'reverse' tapered. This allows the combination in a single device of both the conventional mechanism of droplet generation shown as understood in FIG. 1 and FIG. 6. The 'forward' and the 'reverse' tapered perforations may be of roughly similar sizes or of differing sizes. Accordingly, such devices are capable of creating droplets by one mechanism at one operating frequency and by the other mechanism at another frequency. Similarly, such devices are capable to create droplets 1011 of relatively large size from normally tapered perforations 1060 by one mechanism and droplets 1010 of relatively small size from 'reverse' tapered perforations 1050 by the other mechanism. Further, it is possible to create sprays of relatively high velocity by one mechanism and of relatively small velocity by the other mechanism. Other combinations of droplet size, operating frequency and droplet velocity will be apparent. Finally the droplet production mechanism of the 'normally' tapered perforations 1060 can also, for example in a bubble-generator enclosure design as described above, be used to create a negative pressure bias for improved droplet generation from the 'reverse' tapered regions of the membrane.

The best conditions and details of the atomising head of that apparatus currently known to the inventors have been described with reference to FIGS. 3*b,* 4, 5*b* and 6*e* to 6*g* above.

Notwithstanding the drawings, it is to be understood that devices according to the present invention may be operated in a range of orientations, spraying downwards, sidewards or upwards.

We claim:

1. A liquid droplet spray device comprising:

a perforate membrane having first face and a second face and first perforations;

an actuator, for vibrating the membrane; and means for supplying liquid to the first face of the membrane, wherein the first perforations in the membrane have a reverse taper, namely a larger cross-sectional area at the second face of the membrane from which liquid droplets emerge than the first face of the membrane.

2. A device according to claim 1, further including a liquid reservoir for containing the liquid at a reduced pressure at the liquid contacting first face.

3. A device according to claim 2, wherein the reduced pressure lies in the range of about zero to about a pressure determined by the liquid which is sufficient to draw air from the second face through the first perforations and through the fluid.

4. A device according to claim 1, wherein the perforations, on that face of the membrane away from which liquid droplets emerge, are not touching.

5. A device according to claim 1, wherein the actuator is a piezoelectric actuator.

6. A device according to claim 5, wherein the piezoelectric actuator is adapted to operate in the bending mode.

7. A device according to claim 1, wherein the means for supplying liquid to a surface of the membrane comprises a capillary feed mechanism.

8. A device according claim 1, wherein the means for supplying liquid to a surface of the membrane comprises a bubble-generator feed mechanism.

9. A device according to claim 1, wherein the perforations have a reverse taper.

10. A device according to claim 9, wherein the membrane further includes second perforations having a taper opposite the taper of the first perforations.

11. A device according to claim 10, wherein the second perforations are disposed around the outside of the first perforations.

12. A device according to claim 10, wherein second perforations supply liquid to the second face of the membrane.

13. A device according to claim 1, wherein the diameter of each perforation is about 1 capillary wavelength.

14. A device according to claim 1, wherein the actuator is arranged to vibrate said membrane such that the following relation is satisfied:

$$\frac{12\pi\sigma n^3}{\rho} > f^2\phi^3 > \frac{5\pi\sigma n^3}{\rho}$$

where:

$\phi$=the diameter of the tapered perforation at a selected point between the front and the rear face of the membrane n=an integer $\lambda_c$=the wavelength of capillary waves in the liquid $\sigma$=fluid surface tension (at frequency f)

$\rho$=fluid density f=an operating frequency of the actuator.

15. A device according to claim 1, wherein the actuator is arranged to vibrate said membrane in a frequency range of about 20 kHz to about 7 MHz.

16. A method of atomising a liquid in which a liquid is caused to pass through tapered first perforations in a vibrating membrane in the direction from a first side of the membrane at which the first perforations have a smaller cross-sectional area to a second side of the membrane at which the first perforations have a larger cross-sectional area.

17. A method according to claim 16, further including establishing a reduced pressure in the liquid opposing the passage of the liquid through the first perforations from the first side to the second side.

18. A method according to claim 17, wherein the reduced pressure lies in the range of about zero to about a pressure determined by the liquid which is sufficient to draw air the first perforations of the membrane and through the fluid.

19. A method according to claim 16, wherein the actuator is a piezoelectric actuator and is caused to operate in the bending mode.

20. A method according to claim 16, wherein the liquid is supplied to the first dose of the membrane through a capillary feed mechanism.

21. A method according to claim 16, wherein the liquid is supplied to the first face of the membrane through a bubble-generator feed mechanism.

22. A method according to claim 16, wherein the liquid is supplied to the second face of said membrane from which liquid droplets emerge.

23. A method according to claim 16, wherein the liquid is supplied to the first face of said membrane.

24. A method according to claim 16, wherein the actuator causes said membrane to vibrate such that the following relation is satisfied:

$$\frac{12\pi\sigma n^3}{\rho} > f^2\phi^3 > \frac{5\pi\sigma n^3}{\rho}$$

where:

$\phi$=the diameter of the tapered perforation at a selected point between the front and the rear face of the membrane n=an integer $\lambda_c$=the wavelength of capillary waves in the liquid $\sigma$=fluid surface tension (at frequency f)

$\rho$=fluid density f=an operating frequency of the membrane.

25. A method according to claim 16, wherein the membrane is vibrated at a frequency in the range of about 20 kHz to about 7 MHz.

26. A liquid droplet spray device comprising:

a perforate membrane having first face and a second face away from which droplets emerge;

an actuator, for vibrating the membrane; and means for supplying liquid to at least one of the first and second faces of the membrane, wherein perforations in the membrane have a reverse taper, namely a larger cross-sectional area at the second face of the membrane than the first face of the membrane.

27. The liquid droplet spray device of claim 26, wherein the droplets emerge from a liquid meniscus formed on at least one of the first face and the second face.

* * * * *